US005658398A

United States Patent [19]

Yoshizawa et al.

[11] Patent Number: 5,658,398

[45] Date of Patent: Aug. 19, 1997

[54] ALLOY WITH ULTRAFINE CRYSTAL GRAINS EXCELLENT IN CORROSION RESISTANCE

[75] Inventors: Yoshihito Yoshizawa, Fukaya; Shunsuke Arakawa, Kumagaya; Katsuhisa Sugimoto, Sendai, all of Japan

[73] Assignee: Hitachi Metals, Ltd., Tokyo, Japan

[21] Appl. No.: 628,444

[22] Filed: Apr. 5, 1996

Related U.S. Application Data

[63] Continuation of Ser. No. 314,771, Sep. 29, 1994, abandoned, which is a continuation-in-part of Ser. No. 115,777, Sep. 3, 1993, abandoned.

[30] Foreign Application Priority Data

Sep. 3, 1992 [JP] Japan ..... 4-235467

[51] Int. Cl.[6] ..... H01F 1/147

[52] U.S. Cl. ..... 148/306; 148/105; 148/122; 427/127; 428/403; 428/469; 428/472.1; 428/472.2

[58] Field of Search ..... 148/306, 307, 148/309, 105, 314, 771, 122; 427/127; 428/403, 469, 472.1, 472.2

[56] References Cited

U.S. PATENT DOCUMENTS 3,902,888 9/1975 Aonuma et al. ..... 148/105
4,881,989 11/1989 Yoshizawa et al. ..... 148/302

*Primary Examiner*—John Sheehan
*Attorney, Agent, or Firm*—Sughrue, Mion, Zinn, Macpeak & Seas

[57] ABSTRACT

There is provided an alloy with ultrafine crystal grains excellent in corrosion resistance, at least 50% of the alloy structure being occupied by ultrafine crystal grains, the alloy having a surface layer containing hydroxide components in a total proportion of 65% or more based on oxide components.

18 Claims, 7 Drawing Sheets

ALLOY WITH ULTRAFINE CRYSTAL GRAINS EXCELLENT IN CORROSION RESISTANCE

CROSS-REFERENCE TO RELATED APPLICATION

This is a Continuation of application Ser. No. 08/314,771 filed Sep. 29, 1994 abandoned, which is is a continuation-in-part of application U.S. Ser. No. 08/115,777, filed Sep. 3, 1993, now abandoned.

BACKGROUND OF THE INVENTION

This invention relates to an ultrafine-crystalline alloy excellent in soft magnetic properties and corrosion resistance.

Silicon steel, Fe-Si alloys, amorphous alloys, etc. are well known as soft magnetic materials, and their important properties are high relative permeability μ and saturation magnetic flux density Bs.

In addition to magnetic properties, corrosion resistance is an important property since these magnetic materials would be used under various circumstances.

However, it had been considered difficult to achieve both high saturation magnetic flux density Bs and high relative permeability μ at a time in the magnetic materials. Fe-based amorphous alloys have, for example, high saturation magnetic flux density Bs, while they are inferior to Co-based amorphous alloys in soft magnetic properties. On the other hand, the Co-based amorphous alloys are excellent in soft magnetic properties, while they do not have sufficient saturation magnetic flux density Bs.

High saturation magnetic flux density Bs and high relative permeability μ had conventionally been thought incompatible. U.S. Pat. No. 4,881,989 discloses an Fe-based soft magnetic alloy with ultrafine crystal grains having both high saturation magnetic flux density Bs and high relative permeability μ. This Fe-based alloy having an average grain size of 500 Å or less is produced through a crystallization process after it is quenched rapidly into an amorphous state. This Fe-based alloy with ultrafine crystal grains has good corrosion resistance to some extent because it contains Nb, etc. The corrosion resistance of this Fe-based alloy, however, may not be sufficient depending on surroundings in which it is used.

OBJECT AND SUMMARY OF THE INVENTION

Accordingly, an object of the present invention is to provide an alloy with ultrafine crystal grains having improved corrosion resistance.

As a result of an intense research for solving the above problems, the inventors have found that the alloy having a specific surface layer shows extremely improved corrosion resistance.

The alloy with ultrafine crystal grains according to the present invention has an alloy structure, at least 50% of which is occupied by ultrafine crystal grains, and has a surface layer in which the total proportion of hydroxide components is 65% or more based on oxide components, thereby showing excellent corrosion resistance.

DETAILED DESCRIPTION OF THE INVENTION

Figure 1:
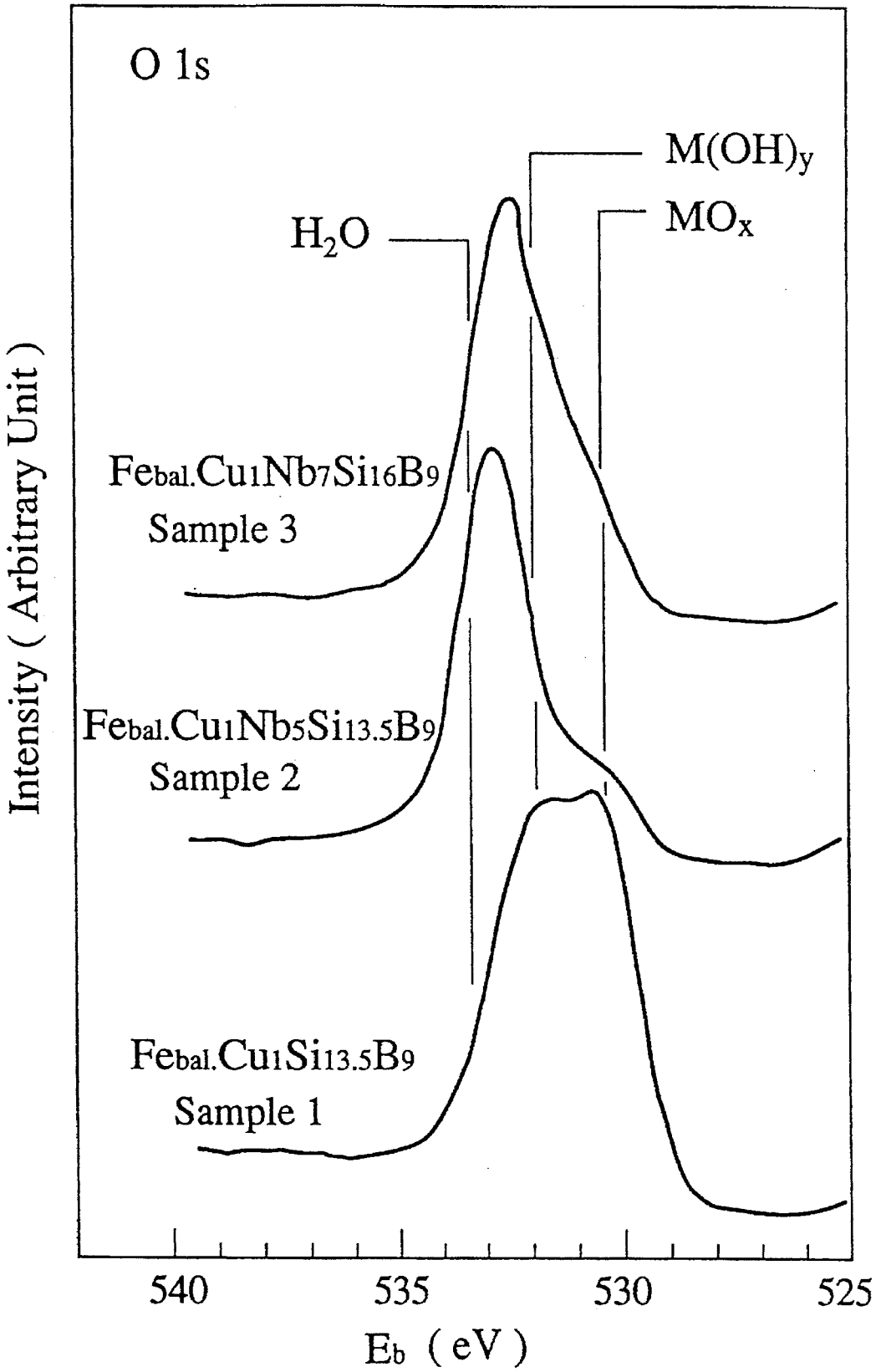
FIG. 1 is a graph showing the 1s spectra of O in the surface layers of the fine crystalline alloys of the present invention.

The present invention will be described in detail below.

The surface layers of the fine crystalline alloy according to the present invention can be identified by X-ray photoelectron spectroscopy ESCA. ESCA is a chemical element analysis comprising the steps of applying X-ray to a sample and detecting photoelectrons emitted from the sample for identifying chemical bonds of elements by chemical shift values of bond energies. In the description of the present invention, the presence of hydroxides is confirmed by observing peaks attributed to hydroxides in an ESCA spectrum. Same is true of oxide components. More specific understanding can be attained by examples described below.

As is shown by Examples below, when the fine crystalline alloys contain larger amounts of hydroxide components than those of oxide components in the surface layers, they show excellent corrosion resistance. In this case, when the surface layers are thin in the Fe-based alloys, $Fe^0$ under the surface layers (inside alloys) is strongly detected. On the other hand, $Fe^{2+}$ and $Fe^{3+}$ are observed in the surface layers. Furthermore, in the case of the fine crystalline alloys containing Si, they show excellent corrosion resistance if the surface layers contain $Si^{4+}$. When $Si^{4+}$ exists in the form of $SiO_2$, the fine crystalline alloys show excellent corrosion resistance in most cases.

When the surface layers of the fine crystalline alloys contain oxides of at least one element selected from the group consisting of Ta, Nb and Cr, they have particularly excellent corrosion resistance. In that case, these elements are not necessarily in the state of complete oxides but usually are in an intermediate state between oxides and metals. When they contain at least one element selected from the group consisting of Zr, Hf and W, their corrosion resistance in an alkaline environment is improved.

When the average grain size is as small as 500 Å or less in the fine crystalline alloy, corrosion resistance is further improved, and magnetic and mechanical properties are also improved to a level preferable for practical applications. Particularly desirable average grain size is from 20 Å to 200 Å since the structure of the fine crystalline alloy is fine and uniform in this average grain size range.

An example of the fine crystalline alloys to which the present invention is applicable has a composition represented by the general formula:

$$M_{100-x-y-z-\alpha-\beta-\gamma}A_xSi_yB_zM'_\alpha M''_\beta X_\gamma \text{ (atomic \%)}$$

wherein M represents at least one element selected from the group consisting of Fe, Co and Ni; A represents at least one element selected from the group consisting of Cu, Ag and Au; M' represents at least one element selected from the group consisting of Nb, Mo, Ta, Ti, Zr, Hf, V, Cr and W; M" represents at least one element selected from the group consisting of Mn, Al, platinum group elements, Sc, Y, rare earth elements, Zn, Sn and Re; X represents at least one element selected from the group consisting of C, Ge, P, Ga, Sb, In, Be and As, $0<x<10$, $0<y<30$, $0<z<25$, $0<y+z<30$, $1<\alpha<20$, $0<\beta<20$, and $0<\gamma<20$.

The element M is at least one ferromagnetic element selected from the group consisting of Fe, Co and Ni.

The element A representing at least one element selected from the group consisting of Cu, Ag and Au, which effectively makes the alloy structure finer in cooperation with the element M'.

The element M' representing at least one element selected from the group consisting of Nb, Mo, Ta, Ti, Zr, Hf, V, Cr and W makes the alloy structure considerably finer in cooperation with the element A. Among the elements mentioned above, at least one element selected from the group consisting of Nb, Ta and Cr makes it easier to provide the surface layer with improved corrosion resistance.

Si and B are effective elements for making the alloys amorphous, for improving magnetic properties, and for making the alloy structure finer. Si functions to improve the corrosion resistance of the surface layers of the fine crystalline alloys, and if Si exists in the form of $SiO_2$ in the surface layers, their corrosion resistance is extremely improved.

The element M" representing at least one element selected from the group consisting of Mn, Al, platinum group elements, Sc, Y, rare earth elements, Zn, Sn and Re is effective for improving corrosion resistance and for controlling magnetic properties.

The element X representing at least one element selected from the group consisting of C, Ge, P, Ga, Sb, In, N, Be and As is effective for making the alloy structure amorphous and for controlling magnetic properties.

With the above-mentioned surface layers, the corrosion rate of the fine crystalline alloys in a 0.1-kmol.m$^{-3}$ NaCl aqueous solution can be reduced to as small as $1\times10^{-8}$ kg.m$^{-2}$.s$^{-1}$ or less.

The fine crystalline alloys of the present invention can be produced by the steps of preparing amorphous alloys by a liquid quenching method such as a single roll method, a double roll method, a rotating liquid spinning method, etc., or by a gas phase quenching method such as a sputtering method, a vapor deposition method, etc., and conducting a heat treatment on the amorphous alloys for turning at least 50% of the alloy structures into ultrafine crystal grains. Though the balance of the alloy structures is usually amorphous, the present invention includes alloys having alloy structures practically consisting of ultrafine crystal phase. The fine crystalline alloys of the present invention can also be produced by the steps of forming amorphous alloy layers in surface portions of alloys by applying laser rays thereto, and conducting a heat treatment thereon. The powdery alloys of the present invention can be produced by conducting a heat treatment on atomized amorphous alloys.

In the processes having a heat treatment step, the heat treatment is preferably conducted at 450° C.–800° C. When the heat treatment temperature is lower than 450° C., fine crystallization is difficult even though the heat treatment is conducted for a long period of time. On the other hand, when it exceeds 800° C., the crystal grains grow excessively, failing to obtain the desired ultrafine crystal grains. The preferred heat treatment temperature is 500°–700° C. Incidentally, the heat treatment time is generally 1 minute to 200 hours, preferably 5 minutes to 24 hours. The heat treatment temperatures and time may be determined within the above ranges depending upon the compositions of the alloys. The above heat treatment may be conducted in an inert atmosphere.

The heat treatment of the alloys of the present invention can be conducted in a magnetic field. When a magnetic field is applied in one direction, a magnetic anisotropy in one direction can be given to the resulting heat-treated alloys. Also, by conducting the heat treatment in a rotating magnetic field, further improvement in soft magnetic properties can be achieved. In addition, the heat treatment for fine crystallization can be followed by a heat treatment in a magnetic field.

Alternatively, the alloys of the present invention with ultrafine crystal grains can be directly produced without experiencing an amorphous phase by controlling quenching conditions.

It is possible to provide the fine crystalline alloys of the present invention with surface layers containing hydroxide components by a heat treatment in an inert atmosphere containing oxygen and steam (water vapor), or by anode oxidation before or after the crystallization heat treatment.

In the case of the heat treatment in an inert gas atmosphere containing oxygen and steam, the inert gas atmosphere should contain 0.001–1 volume % of oxygen and 1–100 ppm of steam. The preferred oxygen content is about 0.5 volume %, and the preferred steam content is 20–50 ppm.

The heat treatment for forming the surface layers is preferably conducted at 250°–700° C. for 5 minutes to 24 hours. When the heat treatment temperature is lower than 250° C., surface layers with good corrosion resistance cannot be obtained. On the other hand, when it exceeds 700° C., crystal grains become too large in the resultant surface layers.

The heat treatment for forming the surface layers may be conducted at the same time as the heat treatment for fine crystallization. In this case, the heat treatment may be conducted at 450°–700° C. for 10 minutes to 24 hours in the same inert atmosphere containing oxygen and steam as described above.

The surface layer thus formed contains hydroxide components in a total proportion of 65% or more, preferably 65–300%, based on oxide components.

The present invention includes fine crystalline alloys having the above-mentioned surface layers formed by sputtering, vapor deposition, CVD etc.

The present invention will be explained in further detail by way of the following Examples, without intending to restrict the scope of the present invention.

EXAMPLE 1

Three kinds of alloy melts having the following compositions:

Sample 1: $Fe_{bal.}Cu_1Si_{13.5}B_9$,

Sample 2: $Fe_{bal.}Cu_1Nb_5Si_{13.5}B_9$, and

Sample 3: $Fe_{bal.}Cu_1Nb_7Si_{16}B_9$ were rapidly quenched by a single roll method to produce thin amorphous alloy ribbons of 5 mm in width and about 18 μm in thickness. A heat treatment was then conducted to the alloy ribbons at 570° C. in a nitrogen gas atmosphere containing 0.5 volume % of oxygen and 30 ppm of steam for 1 hour. The heat-treated alloys had crystallized structures, 90% or more of which were occupied by ultrafine crystal grains of an average grain size of 100 Å.

The surface layers of the fine crystalline alloys were then observed by ESCA. Procedures and conditions of this analysis were as follows: Each sample cut into a size of 4 mm×4 mm for analysis was fixed to a probe with a double-sided adhesive tape of conductive carbon. Mg-Kα-ray was used for an excitation X-ray, which was generated at 5 kV and 30 mA. The analysis was done at a reduced pressure of $2\times10^{-7}$ Torr or lower.

The corrosion rates of the fine crystalline alloys were also measured in a 0.1-kmol.m$^{-3}$ NaCl aqueous solution. The measured corrosion rates of the fine crystalline alloys were as follows:

Sample 1: $2.02\times10^{-8}$ kg.m$^{-2}$.s$^{-1}$,

Sample 2: $8.27\times10^{-11}$ kg.m$^{-2}$.s$^{-1}$, and

Sample 3: almost 0 kg.m$^{-2}$.s$^{-1}$.

The 1s spectra of O in the surface layers of the above fine crystalline alloys are shown in FIG. 1. In the spectra of Samples 2 and 3 excellent in corrosion resistance, the peaks attributed to the hydroxides $M(OH)_y$, wherein M represents a transition metal and y represents a valency of M, were as large as 65% or more, while those attributed to $MO_x$, wherein x represents one-half of the valency of M, were as small as 35% or less. This fact indicates that the fine crystalline alloys having the surface layers in which the total proportion of the peaks attributed to the hydroxides $M(OH)_y$ are as large as 65% or more based on the integrated value of the entire spectrum of M have better corrosion resistance.

Figure 2:
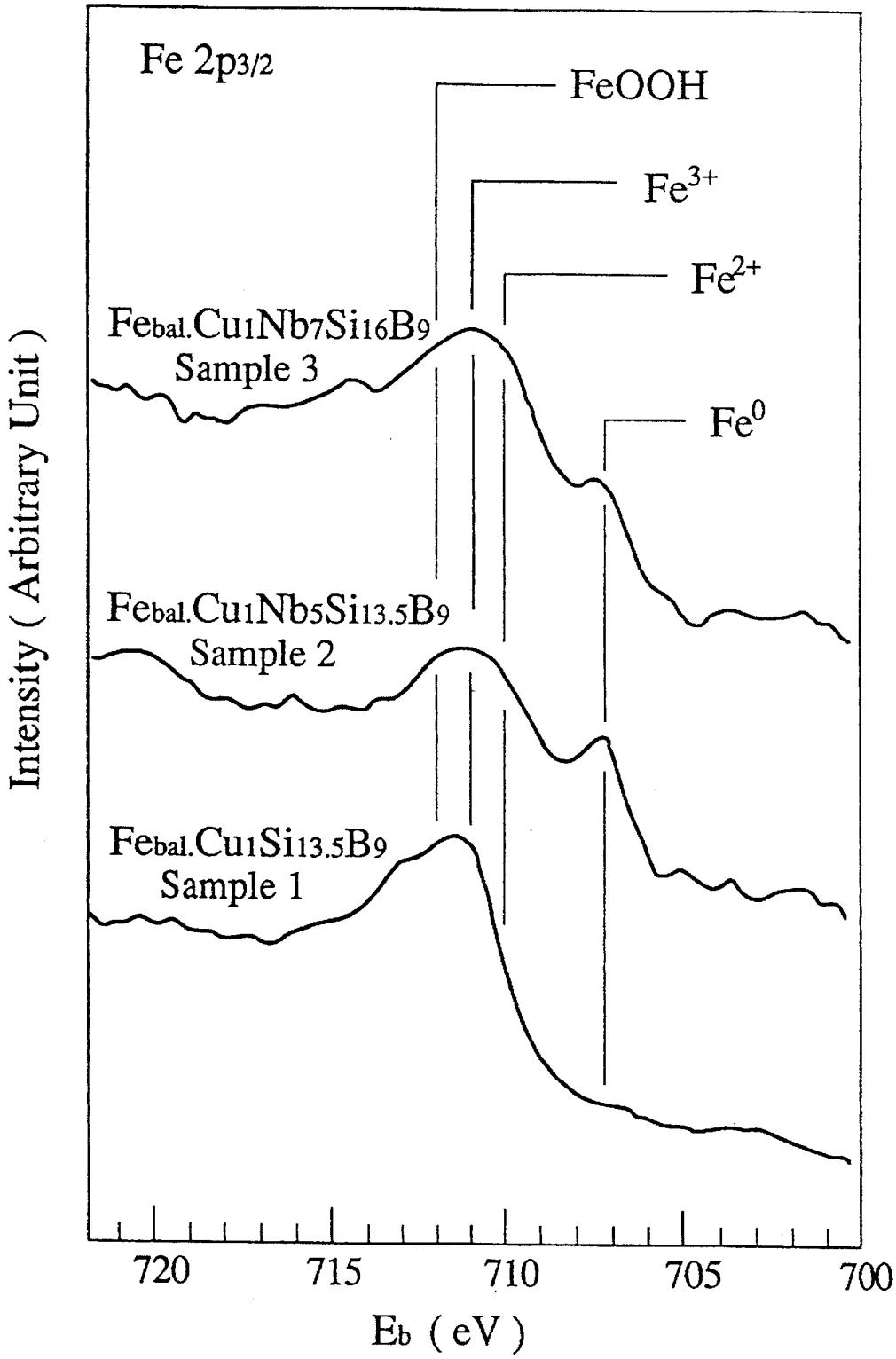
FIG. 2 is a graph showing the $2p_{3/2}$ spectra of Fe in the surface layers of the fine crystalline alloys of the present invention.

The $2p_{3/2}$ spectra of Fe in the surface layers of these fine crystalline alloys are shown in FIG. 2. In all of the fine crystalline alloys, the peaks attributed to $Fe^{2+}$ and $Fe^{3+}$ were observed, indicating that the surface layers contained $Fe_2O_3$, etc. Furthermore, a peak corresponding to FeOOH was also observed in the surface layers. The spectra of $Fe^0$ were observed in the surface layers of Samples 2 and 3 excellent in corrosion resistance. It was, therefore, confirmed that the surface layers were so thin that Fe under the surface layers could be detected.

Figure 3:
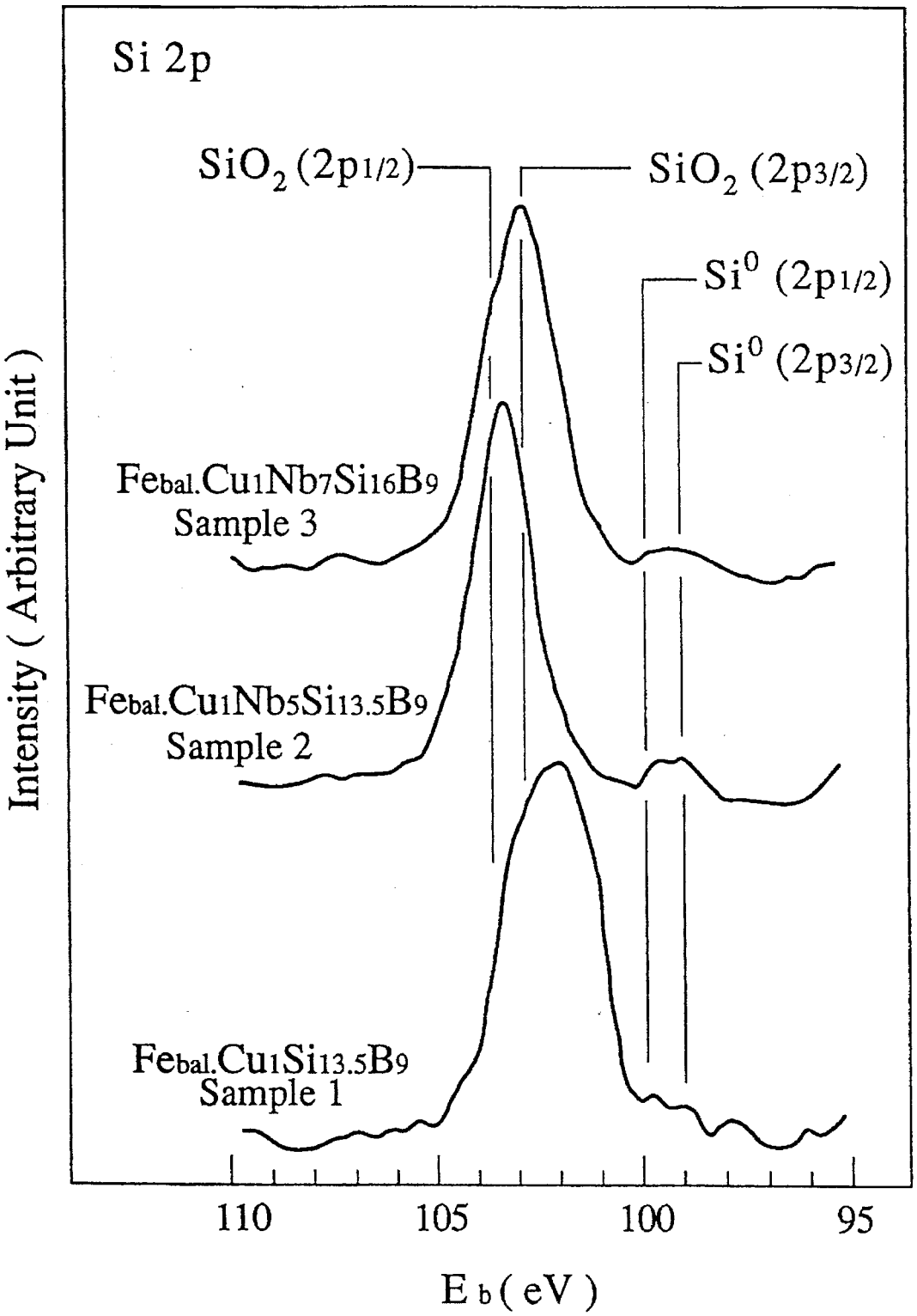
FIG. 3 is a graph showing the 2p spectra of Si in the surface layers of the fine crystalline alloys of the present invention.

The 2p spectra of Si in the surface layers of these fine crystalline alloys are shown in FIG. 3. In the case of Samples 2 and 3 having excellent corrosion resistance, $Si^{4+}$ (identified as $SiO_2$ in FIG. 3) was mainly observed, while components in an intermediate oxidation state between $Si^0$ and $Si^{4+}$ ($SiO_2$) were not observed. The corrosion resistance of the fine crystalline alloys tends to be improved as the amount of $Si^{4+}$ ($SiO_2$) increases.

EXAMPLE 2

Four kinds of alloy melts having the following compositions:

Sample 4: $Fe_{bal.}Cu_1Si_{13.5}B_9$,

Sample 5: $Fe_{bal.}Cu_1Nb_5Si_{13.5}B_9$,

Sample 6: $Fe_{bal.}Cu_1Ta_5Si_{13.5}B_9$, and

Sample 7: $Fe_{bal.}Cu_1Ti_5Si_{13.5}B_9$ were rapidly quenched by a single roll method to produce thin amorphous alloy ribbons of 5 mm in width and about 18 μm in thickness. A heat treatment was then conducted to the alloy ribbons at 590° C. in a nitrogen gas atmosphere containing 0.5% of oxygen and 30 ppm of steam for 1 hour. The heat-treated alloys had crystallized structures, 90% or more of which were occupied by ultrafine crystal grains of an average grain size of 110 Å.

The surface layers of the fine crystalline alloys were observed by X-ray photoelectron spectroscopy ESCA in the same way as described in Example 1. The corrosion rates of the fine crystalline alloys were measured in a 0.1-kmol.m$^{-3}$ NaCl aqueous solution. The measured corrosion rates of the fine crystalline alloys were as follows:

Sample 4: $2.02\times10^{-8}$ kg.m$^{-2}$.s$^{-1}$,

Sample 5: $8.27\times10^{-11}$ kg.m$^{-2}$.s$^{-1}$,

Sample 6: $8.24\times10^{-11}$ kg.m$^{-2}$.s$^{-1}$, and

Sample 7: $1.01\times10^{-9}$ kg.m$^{-2}$.s$^{-1}$.

Figure 4:
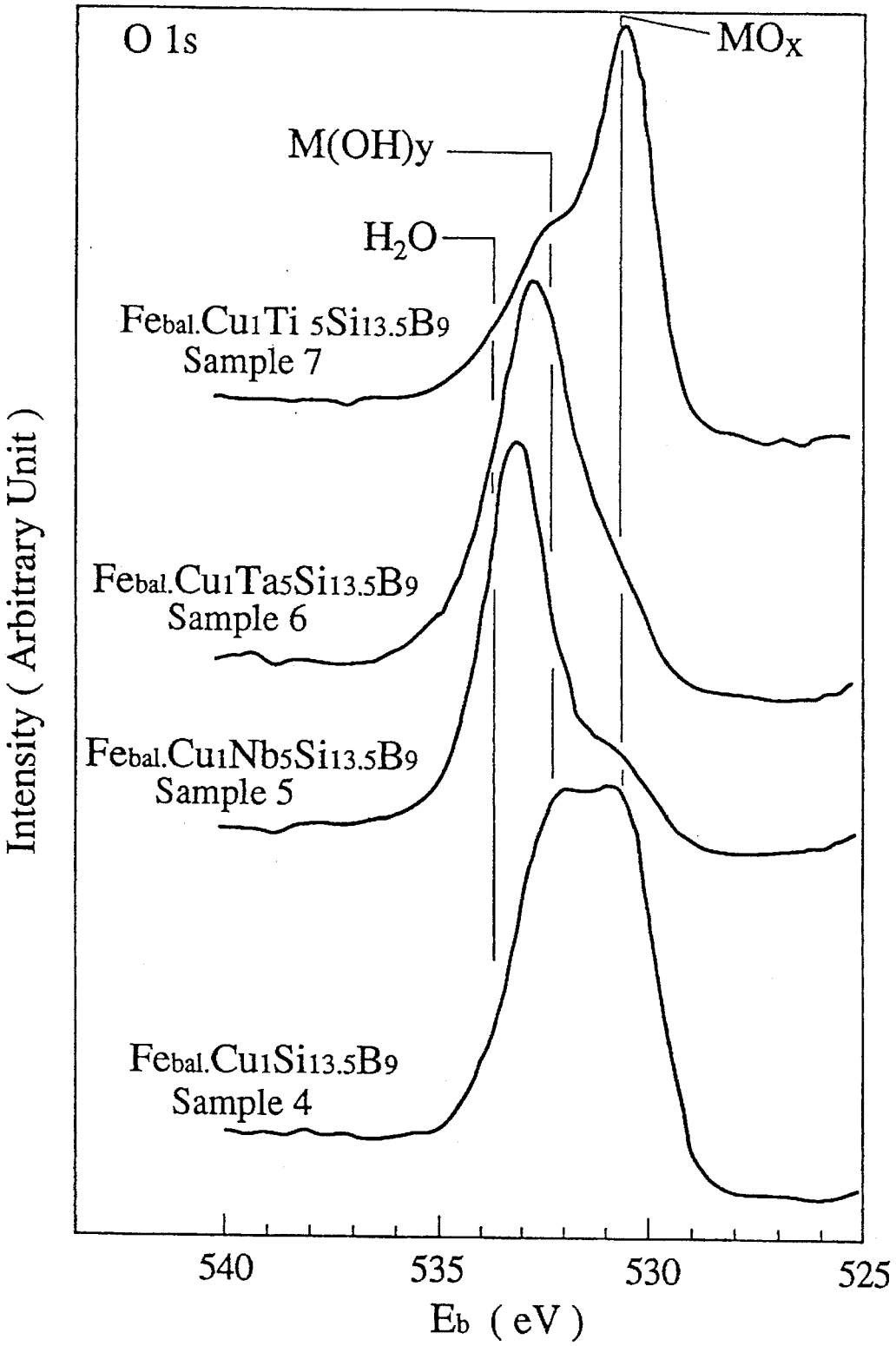
FIG. 4 is a graph showing the 1s spectra of O in the surface layers of the fine crystalline alloys of the present invention.

The 1s spectra of O in the surface layers of the above fine crystalline alloys are shown in FIG. 4. In the spectra of Samples 5 and 6 excellent in corrosion resistance, the peaks attributed to the hydroxides $M(OH)_y$ were as large as 65% or more, while those attributed to $MO_x$ were as small as 35% or less. This fact indicates that the fine crystalline alloys having the surface layers in which the total proportion of the peaks attributed to the hydroxides $M(OH)_y$ are as large as 65% or more based on the integrated value of the entire spectrum of M have better corrosion resistance.

Figure 5:
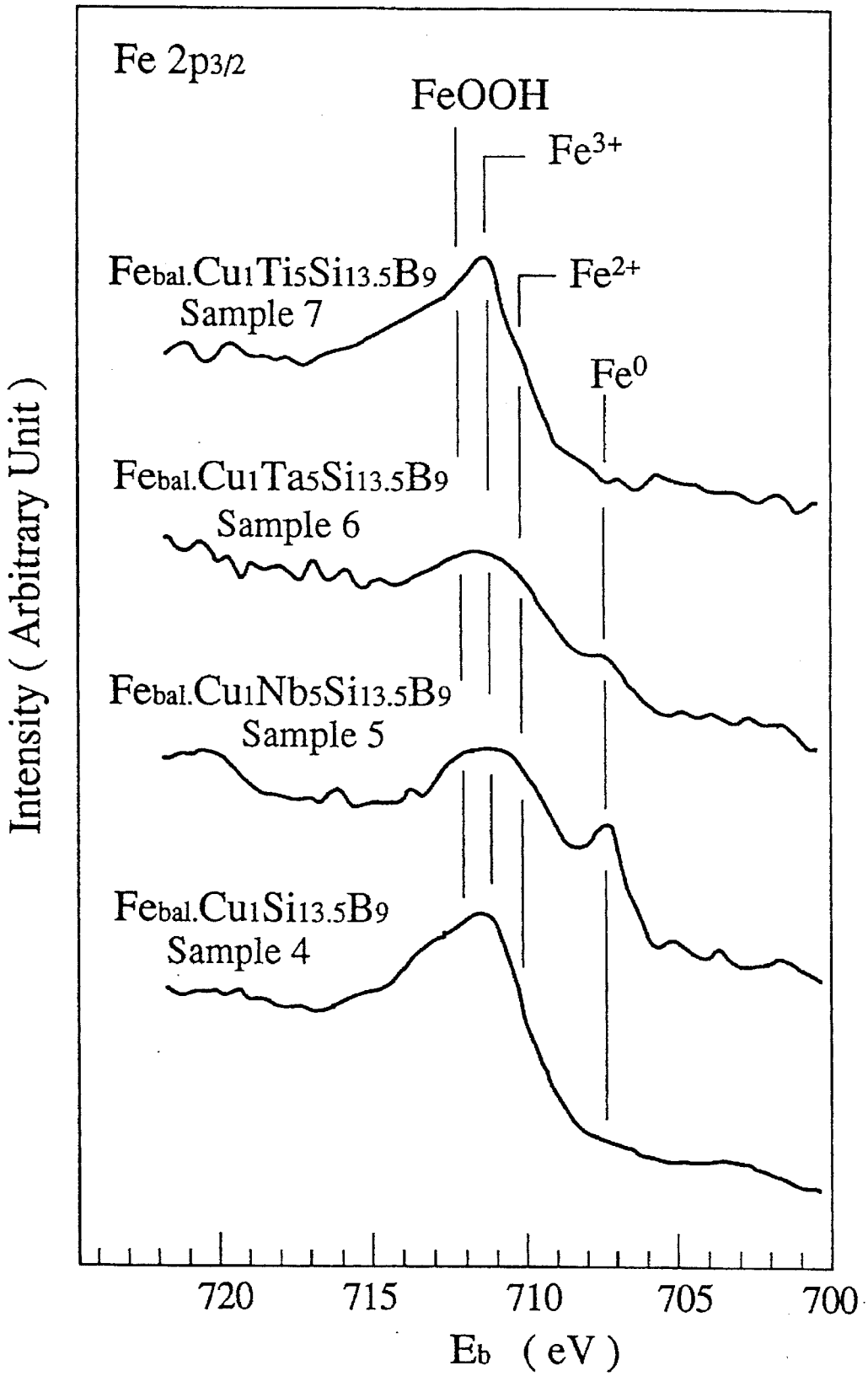
FIG. 5 is a graph showing the $2p_{3/2}$ spectra of Fe in the surface layers of the fine crystalline alloys of the present invention.

The $2p_{3/2}$ spectra of Fe in the surface layers of these fine crystalline alloys are shown in FIG. 5. The spectra of $Fe^0$ were observed in the surface layers of Samples 5 and 6 excellent in corrosion resistance. It was, therefore, confirmed that the surface layers were so thin that Fe under the surface layers could be detected. The peaks attributed to $Fe^{2+}$ and $Fe^{3+}$ were also observed, indicating that the surface layers contained $Fe_2O_3$, etc. Furthermore, a peak attributed to FeOOH was observed.

Figure 6:
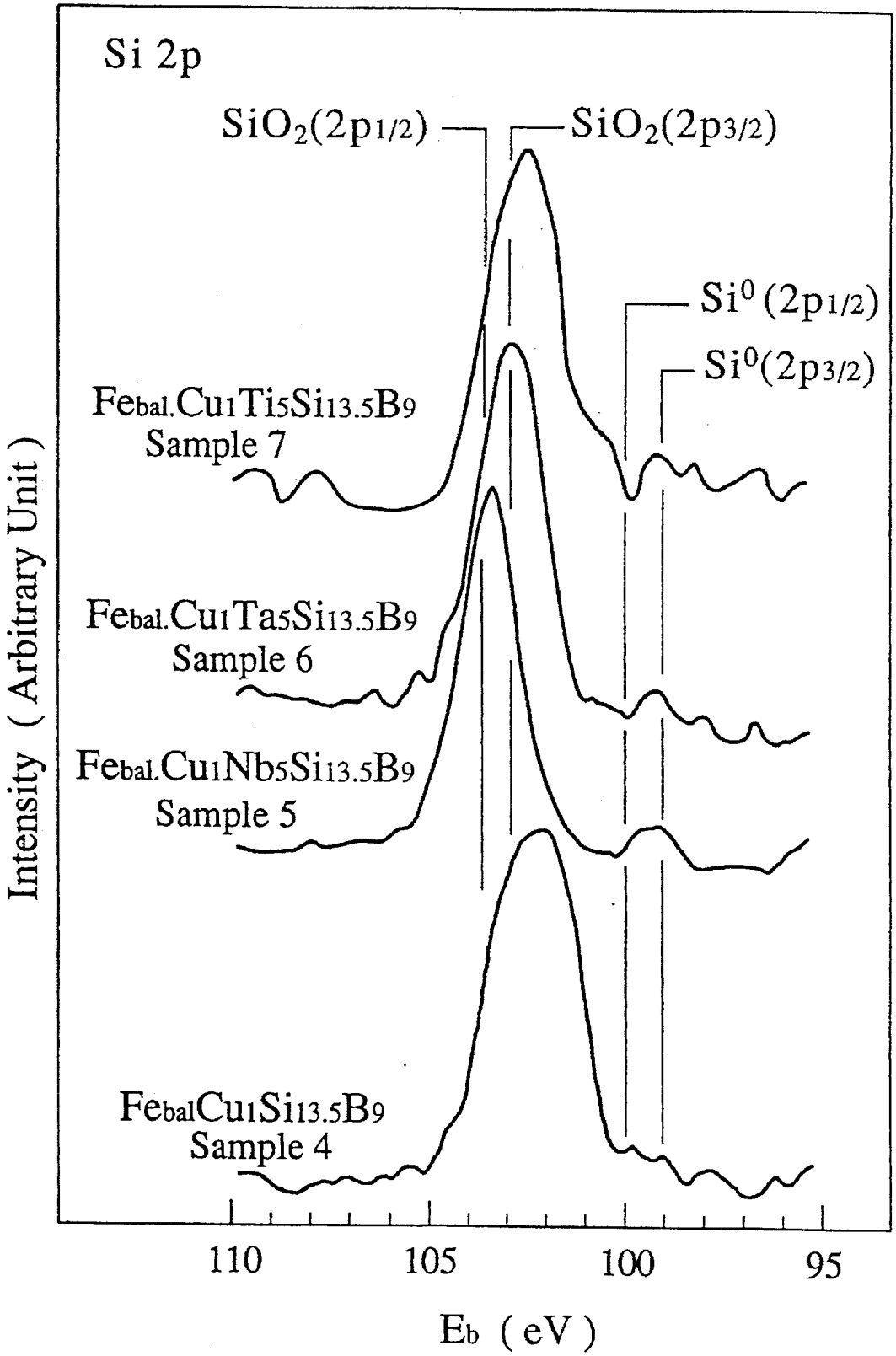
FIG. 6 is a graph showing the 2p spectra of Si in the surface layers of the fine crystalline alloys of the present invention.

The 2p spectra of Si in the surface layers of these fine crystalline alloys are shown in FIG. 6. In the case of Samples 5 and 6 having excellent corrosion resistance, $Si^{4+}$ (identified as $SiO_2$ in FIG. 6) was mainly observed, while components in an intermediate oxidation state between $Si^0$ and $Si^{4+}$ ($SiO_2$) were not observed. The corrosion resistance of the fine crystalline alloys tends to be improved as the amount of $Si^{4+}$ ($SiO_2$) increases.

EXAMPLE 3

Three kinds of alloy melts having the following compositions:

Sample 8: $Fe_{bal.}Cu_1Nb_5Si_{13.5}B_9$,

Sample 9: $Fe_{bal.}Cu_1Ta_5Si_{13.5}B_9$, and

Sample 10: $Fe_{bal.}Cu_1Ti_5Si_{13.5}B_9$ were rapidly quenched by a single roll method to produce thin amorphous alloy ribbons of 5 mm in width and about 18 μm in thickness. A heat treatment was then conducted on the alloy ribbons at 590° C. in a nitrogen gas atmosphere containing 0.001 volume % of oxygen and 10 ppm of steam for 1 hour. The heat-treated alloys had crystallized structures, 90% or more of which were occupied by ultrafine crystal grains of an average grain size of 100 Å. After the heat treatment, the fine crystalline alloys were anodized to form surface oxide layers under the following conditions:

Sample 8 In 0.1-kmol.m$^{-3}$ NaCl aqueous solution at 298K at −0.2 V (vs. Ag/AgCl) for 1 hour, Sample 9 In 0.1-kmol.m$^{-3}$ NaCl aqueous solution at 298K at +0.3 V (vs. Ag/AgCl) for 1 hour, and Sample 10 In 0.1-kmol.m$^{-3}$ NaCl aqueous solution at 298K at −0.2 V (vs. Ag/AgCl) for 1 hour.

Figure 7:
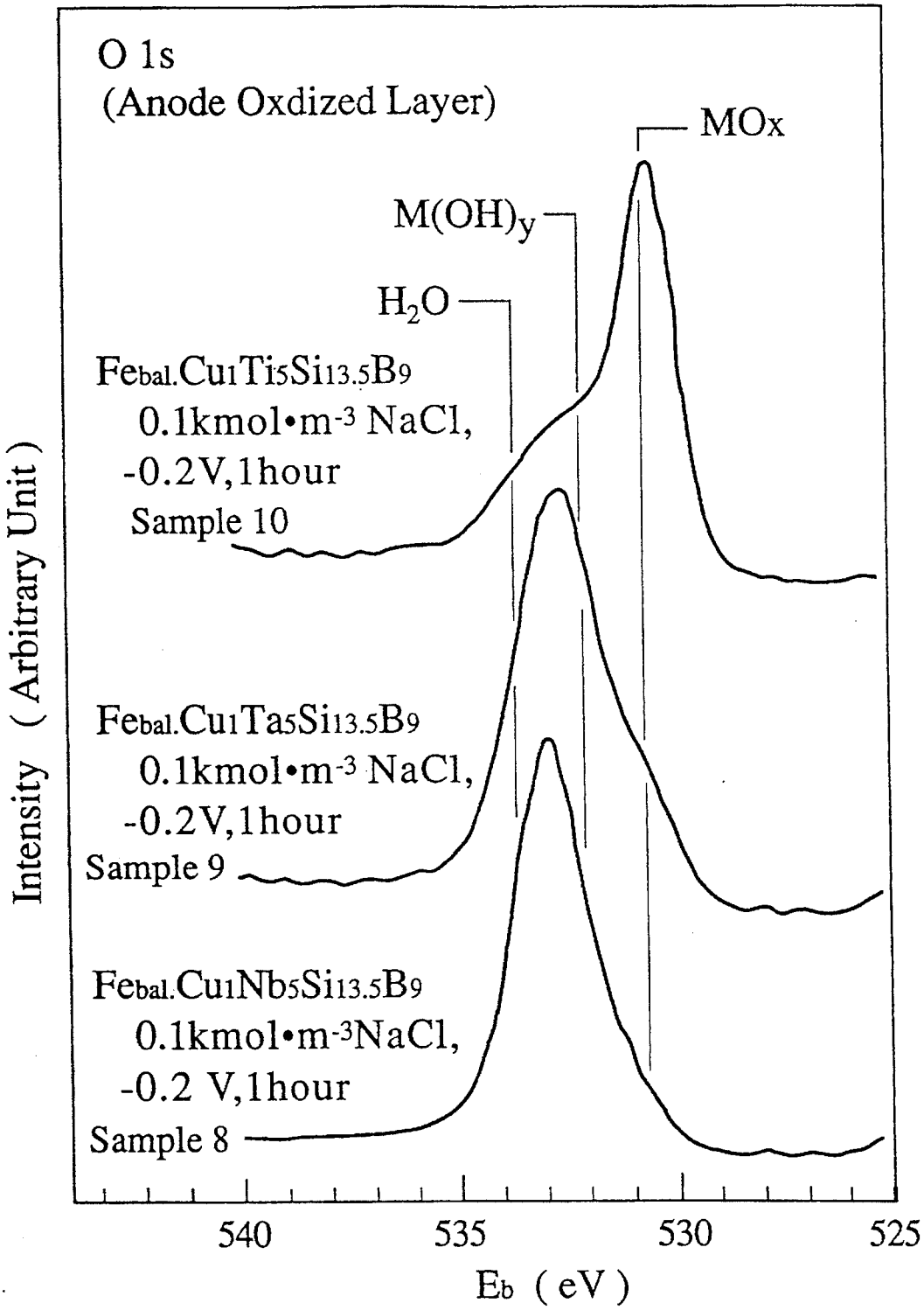
FIG. 7 is a graph showing the 1s spectra of O in the surface layers of the fine crystalline alloys of the present invention formed by anodizing.

The 1s spectra of O in the surface layers of the above fine crystalline alloys are shown in FIG. 7. In the spectra of Samples 8 and 9 having excellent corrosion resistance, the peaks attributed to the hydroxides $M(OH)_y$ were as large as 65% or more, while those attributed to $MO_x$ were as small as 35% or less. This fact indicates that the fine crystalline alloys having the surface layers in which the total proportion of the peaks attributed to the hydroxides $M(OH)_y$ are as large as 65% or more based on the integrated value of the entire spectrum of M have better corrosion resistance.

EXAMPLE 4

Alloy melts having compositions listed in Table 1 were rapidly quenched by a single roll method to produce thin amorphous alloy ribbons of 5 mm in width and about 18 μm in thickness. A heat treatment was then conducted on the alloy ribbons at 570° C. in a nitrogen gas atmosphere containing 0.5% of oxygen and 30 ppm of steam for 1 hour. The heat-treated alloys had crystallized structures, 90% or more of which were occupied by ultrafine crystal grains of an average grain size of 100 Å.

The surface layers of the fine crystalline alloys were then observed by ESCA in the same way as described in Example 1. The ratio of hydroxide components to oxide components and the proportion of $Si^{4+}$ bonds in the surface layers were determined from the ratio in intensity of a peak attributed to each bond to the integrated spectrum intensity of the element. Here, the 1s spectrum of O was assumed to be attributed mainly to four components derived from (1) $H_2O$ adsorbed onto the surfaces of the fine crystalline alloys, derived from (2) hydroxides, derived from (3) $SiO_2$ formed by the oxidation of Si, one of alloy elements, and derived from (4) oxides of Fe, etc., one of alloy elements. Each bond state of O was determined by comparing the observed 1s spectrum of O with a spectrum synthesized from spectra of each bond by approximation of the Gauss-Lorenz mixed distribution.

The ratio of the hydroxide components to the oxide components was defined as a ratio of (a) a proportion of peaks attributed to the hydroxide components in the integrated spectrum of O to (b) a proportion of peaks attributed to the oxide components in the integrated spectrum of O. Incidentally, it is difficult to completely separate each spectrum since peaks in the 1s spectrum of O attributed to the hydroxides components and $Si^{4+}$ ($SiO_2$) are close to each other. Thus, the intensity of a peak attributed to MOx in the 1 s spectrum of O was presumed from the intensity of a peak attributed to $Si^{4+}$ ($SiO_2$) in the 2p spectrum of Si.

The corrosion rates of the fine crystalline alloys were also measured in 0.1-kmol.$m^{-3}$ NaCl aqueous solution like Example 1. The measured corrosion rates, the ratios of hydroxide components to oxide components, and the ratios of $Si^{4+}$ are listed in Tables 1 and 2. In the case of the fine crystalline alloys containing Fe, the surface layers contained compounds of both $Fe^{2+}$ and $Fe^{3+}$.

TABLE 1

| Sample No.(1) | Composition (atomic %) | Corrosion Rate(2) | Hydroxide/ Oxide(3) | Ratio of $Si^{4+}$ (%) |
|---|---|---|---|---|
| 11 | $Fe_{bal}Cu_1Si_{13.5}B_9Nb_5$ | $8.27 \times 10^{-11}$ | 108 | 93 |
| 12 | $Fe_{bal}Cu_1Si_{13.5}B_9Ta_5$ | $8.24 \times 10^{-11}$ | 246 | 91 |
| 13 | $Fe_{bal}Cu_1Si_{13.5}B_9Cr_5$ | $8.27 \times 10^{-11}$ | 201 | 97 |
| 14 | $Fe_{bal}Cu_1Si_{13.5}B_9Zr_5$ | $5.95 \times 10^{-11}$ | 105 | 91 |
| 15 | $Fe_{bal}Cu_1Si_{13.5}B_9Hf_5$ | $3.30 \times 10^{-10}$ | 98 | 90 |
| 16 | $Fe_{bal}Cu_1Si_{13.5}B_9Nb_5W_2$ | $8.47 \times 10^{-11}$ | 110 | 92 |
| 17 | $Fe_{bal}Cu_1Si_{13.5}B_9Nb_5Hf_5$ | $5.12 \times 10^{-11}$ | 208 | 94 |
| 18 | $Fe_{bal}Cu_1Si_{13.5}B_9Nb_7$ | Almost 0 | 100 | 94 |
| 19 | $Co_{bal}Cu_1Si_{13.5}B_9Nb_5Zr_1$ | $5.25 \times 10^{-11}$ | 125 | 95 |
| 20 | $Ni_{bal}Cu_1Si_{13.5}B_9Nb_5Cr_5$ | $4.65 \times 10^{-11}$ | 140 | 96 |
| 21 | $Fe_{bal}Au_1Si_{10}B_6Zr_7$ | $8.95 \times 10^{-11}$ | 97 | 86 |
| 22 | $Fe_{bal}Cu_1Si_{13.5}B_9Nb_5Al_3$ | $7.89 \times 10^{-11}$ | 115 | 95 |
| 23 | $Fe_{bal}Cu_1Si_{13.5}B_9Nb_5Ge_3$ | $8.86 \times 10^{-11}$ | 98 | 90 |
| 24 | $Fe_{bal}Cu_1Si_{13.5}B_9Nb_5Ga_1$ | $9.26 \times 10^{-11}$ | 96 | 88 |
| 25 | $Fe_{bal}Cu_1Si_{13.5}B_9Nb_5P_1$ | $8.36 \times 10^{-11}$ | 92 | 87 |

TABLE 1-continued

| Sample No.(1) | Composition (atomic %) | Corrosion Rate(2) | Hydroxide/ Oxide(3) | Ratio of $Si^{4+}$ (%) |
|---|---|---|---|---|
| 26 | $Fe_{bal}Cu_1Si_{13.5}B_9Nb_5Ru_2$ | $7.29 \times 10^{-11}$ | 120 | 89 |
| 27 | $Fe_{bal}Cu_1Si_{13.5}B_9Nb_5Pd_2$ | $8.52 \times 10^{-11}$ | 101 | 88 |
| 28 | $Fe_{bal}Cu_1Si_{13.5}B_9Nb_5Pt_2$ | $7.94 \times 10^{-11}$ | 99 | 92 |
| 29 | $Fe_{bal}Cu_1Si_{13.5}B_9Nb_5C_{0.2}$ | $8.78 \times 10^{-11}$ | 118 | 86 |
| 30 | $Fe_{bal}Cu_1Si_{13.5}B_9Nb_5Mo_2$ | $8.12 \times 10^{-11}$ | 120 | 88 |
| 31 | $Fe_{bal}Cu_1Si_{13.5}B_9Nb_5Mn_5$ | $9.46 \times 10^{-11}$ | 105 | 89 |
| 32 | $Fe_{bal}Cu_1Si_{12}B_8Nb_5$ | $9.8 \times 10^{-9}$ | 65 | 72 |
| 33 | $Fe_{bal}Cu_1Si_{12}B_7Nb_5Ca$ | $5.24 \times 10^{-10}$ | 66 | 78 |
| 34 | $Fe_{bal}Cu_1Si_{11}B_8Nb_5Ga_3$ | $2.12 \times 10^{-10}$ | 68 | 80 |
| 35 | $Fe_{bal}Cu_1Si_{13}B_7Ta_5Ru_1$ | $1.04 \times 10^{-10}$ | 70 | 82 |

Note:
(1)Examples of the present invention.
(2)Unit is kg · $m^{-2}$ · $s^{-1}$.
(3)Ratio of hydroxides to oxides (%).

(3) Ratio of hydroxides to oxides (%).

TABLE 2

| Sample No.(1) | Composition (atomic %) | Corrosion Rate(2) | Hydroxide/ Oxide(3) | Ratio of $Si^{4+}$ (%) |
|---|---|---|---|---|
| 36 | $Fe_{bal}Cu_1Si_{13.5}B_9$ | $2.02 \times 10^{-8}$ | 64 | 55 |
| 37 | $Fe_{bal}Cu_1Si_{13.5}B_9Ti_1$ | $1.58 \times 10^{-8}$ | 63 | 62 |
| 38 | $Fe_{bal}Cu_1Si_{13.5}B_9W_3$ | $2.04 \times 10^{-8}$ | 62 | 52 |
| 39 | $Fe_{bal}Cu_1Si_{13.5}B_9Mn_5$ | $2.28 \times 10^{-8}$ | 60 | 51 |

Note:
(1)Comparative Examples.
(2)Unit is kg · $m^{-2}$ · $s^{-1}$.
(3)Ratio of hydroxides to oxides (%).

It is clear from Tables 1 and 2 that the ratios (hydroxide components to oxide components) was 65% or more in the surface layers of the fine crystalline alloys, the fine crystalline alloys showed excellent corrosion resistance. Particularly when the surface layers contain $Si^{4+}$ ($SiO_2$), and when the ratio of $Si^{4+}$ peaks to the integrated value of the entire 2p spectrum of Si is more than 55%, the fine crystalline alloys show excellent corrosion resistance (very small corrosion rate). Fine crystalline alloys containing Ta, Nb and Cr have particularly excellent resistance owing to oxides of these elements.

The present invention can provide fine crystalline alloys having excellent corrosion resistance.

What is claimed is:

1. An alloy with ultrafine crystal grains, excellent in corrosion resistance, having a composition represented by the following general formula:

$$M_{100-x-y-z-\alpha-\beta-\gamma}A_xSi_yB_zM'_\alpha M''_\beta X_\gamma \text{ (atomic \%)}$$

wherein M is greater than 0 atomic % and represents at least one element selected from the group consisting of Fe, Co and Ni; A represents at least one element selected from the group consisting of Cu, Ag and Au; M' represents at least one element selected from the group consisting of Nb, Mo, Ta, Ti, Zr, Hf, V, Cr and W; M" represents at least one element selected from the group consisting of Mn, Al, platinum group elements, Sc, Y, rare earth elements, Zn, Sn and Re; X represents at least one element selected from the group consisting of C, Ge, P, Ga, Sb, In, Be and As, and x, y, z, α, β, and γ respectively satisfy $0<x<10$, $0<y<30$, $0<z<25$, $0<y+z<30$, $1<\alpha<20$, $0<\beta<20$, and $0<\gamma<20$;

wherein at least 50% of the alloy structure is occupied by ultrafine crystal grains, wherein said alloy has a surface layer containing hydroxide components in a total proportion of 65% or more based on oxide components, and wherein said surface layer is formed by (1) heat-treating an amorphous alloy to provide it with ultrafine crystal grains, and then heat-treating the resulting alloy with ultrafine crystal grains at 250°–700° C. for 5 minutes to 24 hours in an inert gas atmosphere containing 0.001–1 volume % of oxygen and 1–100 ppm of steam; or (2) heat-treating an amorphous alloy at 450°–700° C. for 10 minutes to 24 hours in an inert gas atmosphere containing 0.0001–1 volume % of oxygen and 1–100 ppm of steam.

2. The alloy according to claim 1, wherein said alloy is an Fe-based alloy and has a surface layer containing compounds of $Fe^{2+}$ and $Fe^{3+}$, and wherein $Fe^{0}$ spectrum is observable in said alloy by X-ray photoelectron spectroscopy.

3. The alloy according to claim 1, wherein said alloy contains Si and has a surface layer containing a compound of $Si^{4+}$, and wherein the ratio of $Si^{4+}$ peaks to an integrated value of entire 2p spectrum of Si is more than 55% by X-ray photoelectron spectroscopy.

4. The alloy according to claim 2, wherein said alloy contains Si and has a surface layer containing a compound of $Si^{4+}$, and wherein the ratio of $Si^{4+}$ peaks to an integrated value of entire 2p spectrum of Si is more than 55% by X-ray photoelectron spectroscopy.

5. The alloy according to claim 1, wherein said surface layer contains an oxide of at least one element selected from the group consisting of Ta, Nb and Cr.

6. The alloy according to claim 2, wherein said surface layer contains an oxide of at least one element selected from the group consisting of Ta, Nb and Cr.

7. The alloy according to claim 3, wherein said surface layer contains an oxide of at least one element selected from the group consisting of Ta, Nb and Cr.

8. The alloy according to claim 4, wherein said surface layer contains an oxide of at least one element selected from the group consisting of Ta, Nb and Cr.

9. The alloy according to claim 1, wherein said surface layer contains an oxide of at least one element selected from the group consisting of Zr, Hf and W.

10. The alloy according to claim 2, wherein said surface layer contains an oxide of at least one element selected from the group consisting of Zr, Hf and W.

11. The alloy according to claim 3, wherein said surface layer contains an oxide of at least one element selected from the group consisting of Zr, Hf and W.

12. The alloy according to claim 4, wherein said surface layer contains an oxide of at least one element selected from the group consisting of Zr, Hf and W.

13. The alloy according to claim 1, wherein the corrosion rate of said alloy in a 0.1-kmol.$m^{-3}$ NaCl aqueous solution is $1\times10^{-8}$ kg.$m^{-2}$.$s^{-1}$ or less.

14. The alloy according to claim 2, wherein the corrosion rate of said alloy in a 0.1-kmol.$m^{-3}$ NaCl aqueous solution is $1\times10^{-8}$ kg.$m^{-2}$.$s^{-1}$ or less.

15. The alloy according to claim 3, wherein the corrosion rate of said alloy in a 0.1-kmol.$m^{-3}$ NaCl aqueous solution is $1\times10^{-8}$ kg.$m^{-2}$.$s^{-1}$ or less.

16. The alloy according to claim 1, wherein said alloy comprises ultrafine crystal grains having an average grain size of 500 Å or less.

17. The alloy according to claim 2, wherein said alloy comprises ultrafine crystal grains having an average grain size of 500 Å or less.

18. The alloy according to claim 3, wherein said alloy comprises ultrafine crystal grains having an average grain size of 500 Å or less.

* * * * *